United States Patent [19]

Carr

[11] Patent Number: 4,951,857

[45] Date of Patent: Aug. 28, 1990

[54] PAINT BRUSH CARRIER

[76] Inventor: Michael Carr, 18704 Muncaster Rd., Rockville, Md. 20855

[21] Appl. No.: 154,172

[22] Filed: Feb. 9, 1988

[51] Int. Cl.[5] ..... A45F 5/02

[52] U.S. Cl. ..... 224/230; 224/148; 224/200; 224/242; 224/252; 211/65

[58] Field of Search ..... 224/185, 230, 241, 242, 224/246, 252, 251, 268, 269, 271, 272, 197, 253, 904, 148, 191, 200, 232, 233; 211/65, 66, 96, 168; 248/223.4, 225.1

[56] References Cited

U.S. PATENT DOCUMENTS

| | | | |
|---|---|---|---|
| 1,894,540 | 1/1933 | Peirce | 224/242 |
| 2,387,900 | 10/1945 | Hartwell | 224/232 |
| 2,661,858 | 12/1953 | Howell | 224/148 |
| 3,384,277 | 5/1966 | Hodelka | 224/252 |
| 3,637,120 | 1/1972 | Clay | 224/251 |
| 4,299,345 | 11/1981 | Lanzl | 2124/252 |
| 4,325,503 | 4/1982 | Swinney | 224/268 |
| 4,524,892 | 6/1985 | Ozeki | 224/232 |
| 4,746,042 | 5/1988 | King | 224/128 |

*Primary Examiner*—Henry J. Recla
*Assistant Examiner*—Glenn T. Barrett
*Attorney, Agent, or Firm*—David B. Newman, Jr. & Associates

[57] ABSTRACT

A paint brush carrier is provided for holding a paint brush, comprising a pocket clip, a flat member pivotally connected to the pocket clip, a handle clip attached to the flat member for clipping the handle of the paint brush, and a paint brush container attached to the flat member for holding the brush end of the paint brush.

6 Claims, 1 Drawing Sheet

Fig. 1A
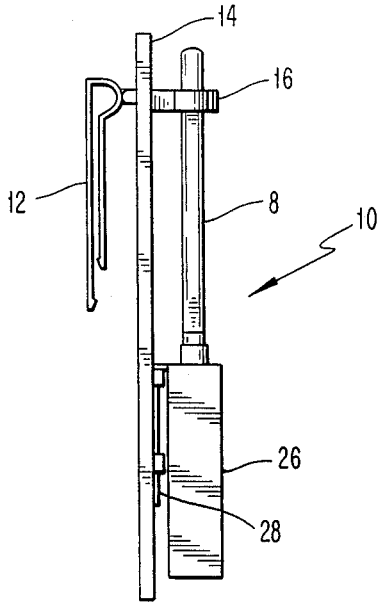
Fig. 1B
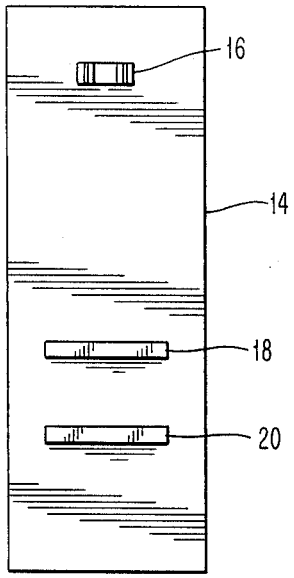
Fig. 1C
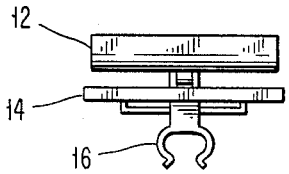
Fig. 1D
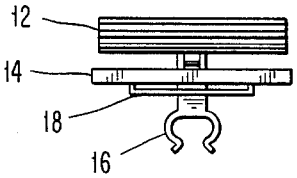
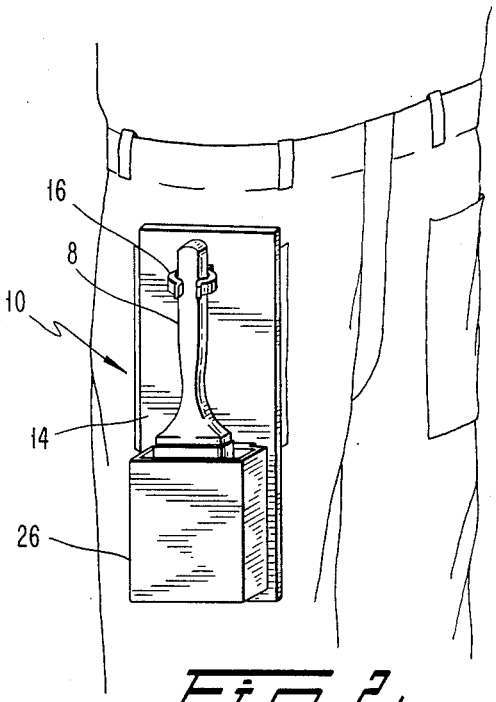
Fig. 2

PAINT BRUSH CARRIER

BACKGROUND OF THE INVENTION

This invention relates to paint brush carriers, and more particularly to a paint brush carriers that can be used by a painter while performing a painting job.

DESCRIPTION OF THE PRIOR ART

When a painter paints the interior of a house, and in particular a room with corners and a ceiling, the painter might paint the walls using a roller type paint brush (paint roller), and the trim between a wall and a floor, the corner where two walls join, or where a wall and a ceiling join, using a paint brush. The paint brush is necessary for this job because the paint roller cannot always put paint into the corners where walls join or where a wall and a ceiling join.

With available products on the market, the painter might have a roller pan for holding paint, and dip the paint roller into the roller pan to put paint on to the roller brush. Similarly, a painter might use a bucket for holding paint, and dip the paint brush into the bucket for putting paint on to the paint brush. As the painter paints the room, the painter might first roll paint onto the broad areas of the walls and ceiling in a room using the paint roller. The paint roller, however, cannot reach into the corners between two walls and between the ceiling and the walls. Thus the painter may set aside the paint roller, proceed to obtain the paint brush from the bucket, and use the paint brush for painting between the corners between two walls. Another approach might be for the painter to roll paint onto a wall, and using the paint roller, "bump" (by pushing with the roller brush) paint into the corners between two walls, or between a wall and a ceiling. The paint brush would be used to spread the paint into the corners. Under this procedure, the painter may lay the paint brush down while he is using the roller brush and then pick up the paint brush when he is ready to spread paint into the corners. The time a painter spends going back and forth picking up and putting down the paint brush while using the paint roller can be quite costly, energy wasting, and time consuming in completing a job.

The present problem as described hereto is exacerbated when a painter is on a ladder and painting a high wall or a high ceiling, and he wishes to cover the corner between two high walls or the corner between a high ceiling and a high wall. Typically, the painter must climb down the ladder, pick up the paint brush from the bucket, and carry the paint brush up the ladder to spread paint into the corners. It is not desirable for the painter to hold the paint brush in his hand while rolling paint from the paint roller while on the ladder, because there is a likelihood that the painter might drop the paint brush, or loose his balance and fall from the ladder.

When a painter leaves a paint brush on the rim of a bucket of paint, the paint brush can slip or fall into the bucket. This results in paint permeating the bristles of the paint brush and covering the handle of the paint brush, increasing the time for cleaning the paint brush.

Thus, in the prior art painters have had a problem when rolling paint on to a wall and spreading paint in the corners, in that the painter has had to switch back and forth between the roller brush and the paint brush. Due to the increase in energy and time a painter expends going between a roller brush and a paint brush, there has been long felt need for an apparatus to minimize the time and energy the painter spends picking up the paint brush so that he can complete a paint job in a more efficient matter.

OBJECTS AND SUMMARY OF THE INVENTION

An object of the present invention is to provide a painter a simple means for carrying and holding a paint brush while he rolls paint onto a wall using a paint roller, and having access to the paint brush for covering corners between two walls, or a wall and a ceiling.

Another object of the invention is to provide a painter with an apparatus that can carry and hold a paint brush while he climbs a ladder and which provides easy access to the paint brush while preparing a window, etc., or rolling paint on to a wall from the ladder.

A further object of the invention is to provide a painter a simple means for carrying a paint brush at his side, or holding a paint brush at the side of a bucket of paint.

A still further object of the invention is to provide easy access to the paint brush for brushing out roller tracks along door and window panes, base boards, wood work, etc.

An additional object of the invention is to provide easy access to the paint brush for picking debris out of the paint on a wall (hair, lint, etc.) instead of using ones fingers.

A still further object of the present invention is to provide a painter an easy and efficient means for having access to a paint brush for covering corners and other inaccessible places from which a roller brush cannot cover.

According to the present invention, as embodied and broadly described herein, a paint brush carrier for use with a paint brush is provided comprising a pocket clip, a flat member having a rectangular shape, a handle clip, and a paint brush container. The pocket clip is for clipping on to the pocket of a pair of pants or a belt of a person or other part of a person. The flat member with the rectangular shape, has a first surface and a second surface with a first end and a second end. The flat member, at the first surface and near the first end of the flat member, is pivotally connected to the pocket clip for allowing the paint brush container to hang vertically so that accumulated paint will not spill from the paint brush container. The handle clip is connected to the flat member at the second surface near the first end of the flat member, and is used for clipping the handle of the paint brush. The paint brush container is for holding the brush end of the paint brush, and is connected near the flat member at the second surface near the second end.

The present invention further can include having a least a first attachment slot connected to the flat member, wherein the attachment slot is located at the second surface near the second end of the flat member. The first attachment slot projects out from the second surface of the flat member. Further, an attachment hook is connected to the paint brush container. The attachment hook inserts into the attachment slot of the flat member, and is for connecting the paint brush container to the flat member. Accordingly, in this embodiment of the present invention, the paint brush container is removable from the flat member, and easily connected to the flat member using the attachment hook in conjunction with the first attachment slot.

The flat member can further have a second attachment slot connected to the flat member which is mounted at the second surface near the second end of the flat member. The second attachment slot projects out from the second surface of the flat member. When the attachment hook inserts into the second attachment slot, and passes through the first attachment slot, the second attachment slot further secures the stability of the attachment hook, and thereby increases the stability of the paint brush container when it is connected to the flat member.

Additional objects and advantages of the invention will be set forth in part in the description which follows, and in part will be obvious from the description, or may be learned by practice of the invention.

BRIEF DESCRIPTION OF THE DRAWINGS

The accompanying drawings, which are incorporated in and constitute a part of this specification, illustrate a preferred embodiment of the invention, and together with the description, serve to explain the principles of the invention.

FIG. 1A shows a side view of the present invention with a pocket clip, pivotally connected to a flat member, with a handle clip and two attachment slots;

FIG. 1B shows a front view of the present invention of the second surface of the flat member with a handle clip attached to the flat member near the first end, and a first attachment slot and a second attachment slot near the second end of the flat member;

FIG. 1C shows a top view of the present invention;

FIG. 1D shows a bottom view of the present invention with the first attachment slot connected to the flat member; and FIG. 2 illustrates the present invention in use with the paint brush carrier clipped to a pair of pants of a painter.

DETAILED DESCRIPTION OF THE PREFERRED EMBODIMENTS

Reference will now be made to the present preferred embodiments of the invention, examples of which are illustrated in the accompanying drawings.

FIG. 1A illustratively shows a side view of the paint brush carrier, FIG. 1B shows a front view and the second surface of the paint brush carrier, FIG. 1C shows a top view of the paint brush carrier, and FIG. 1D shows a bottom view of the paint brush carrier.

A preferred embodiment of the present invention, as illustratively shown in FIGS. 1A–1B, comprises a flat member 14, a pocket clip 12, and a paint brush container 26. The flat member 14 has a rectangular shape with a first and second end, and with a first surface and a second surface. At the first surface near the first end of the flat member 14, the pocket clip 12 is pivotally connected to the flat member 14.

A handle clip 16 is connected to the flat member 14 at the second surface and near the first end of the flat member 14. The handle clip 16 is for clipping the handle of a paint brush when the paint brush is inserted into the paint brush carrier.

In a preferred embodiment of the (instant invention), at least a first attachment slot 18 is connected to the flat member 14 at the second surface and near the second end of the flat member 14. The first attachment slot 18 projects out from the second surface of the flat member 14. This particular embodiment of the present invention can include a second attachment slot 20 connected to the flat member 14 at the second surface and near the second end of the flat member 14. The second attachment slot 20 projects out from the second surface of the flat member 14.

According to the present invention, a paint brush container 26 is included for holding the brush end of the paint brush. An attachment hook 28 is attached to the paint brush container 26. The attachment hook 28 inserts into the attachment slots 18, 20 on the flat member 14, for connecting the paint brush container 26 to the flat member 14.

In a second preferred embodiment of the present invention, the paint brush carrier 10 includes having the paint brush container 26 permanently affixed to the flat member 14.

Paint brush carrier 10, as shown in FIG. 1A, includes the pocket clip 12 for clipping the paint brush carrier 10 onto a pocket of a pair of pants. Alternatively, the paint brush carrier 10 may include the pocket clip 12 for clipping the paint brush carrier 10 onto the belt of a pair of pants, or a loop or other attachment means for connecting and holding the paint brush carrier 10 to a person.

Additionally, the paint brush carrier 10 may be embodied as a "paint brush holder." The paint brush holder includes a bucket clip for clipping the paint brush holder to the side of a bucket, or holder.

FIG. 2 illustratively shows a paint brush carrier 10 clipped on to a pair of pants, and holding a paint brush 8. In use, a painter would have the paint brush carrier 10 clipped to his pair of pants, for example, have the paint brush 8 inserted into the paint brush container 26, and clip the handle of the paint brush 8 with the handle clip 16 to the paint brush carrier 10. Accordingly, as the painter paints a room or climbs a ladder, the paint brush 8 is near the painter's side and readily accessible. Further, the paint brush is securely fastened by the cooperative functioning of the paint brush container 26 and the handle clip 16.

By having flat member 14 pivotally connected to pocket clip 12, the paint brush carrier 10 will hold the paint brush 8 at a near vertical position even as a painter might climb a ladder and have his leg move. This is because the pocket clip 12 which is pivotally connected to flat member 14, will allow the flat member 14 with paint brush 8 inserted into paint brush container 26 to remain in a nearly vertical position while painters's motion might cause his leg or body to move from a vertical to a horizontal position. Thus, the pivotal connection assists in preventing having the paint brush container 26 stay in a vertical position and keeps the painter from dripping paint from the paint brush carrier 10 as a painter moves around.

The handle clip 16 provides a means for securely fastening the handle of the paint brush 8 to the paint brush carrier 10. Further, the paint brush container 26 further assists in securing the paint brush 8 to the paint brush carrier 10, and assists in containing paint which may be on the end of the brush.

First attachment slot 18 operates in combination with attachment hook 28 and provides means for removing paint brush container 26 from the flat member 14. A second attachment slot 20 provides a means for more securely attaching and hooking attachment hook 28 to flat member 14.

The option of having the paint brush container 26 removable from flat member 14 provides the painter with the capability of using multiple paint brush containers for different color paints, and different size brushes. For example, a painter may be painting a room with two colors; the walls may be painted in a flat color, and the trim may be painted in a semi-glossy color. The painter would use a first paint brush container for the paint brush with the flat color, and use a second paint brush container for the paint brush with the second color. The painter simply removes the first paint brush container with the first color and substitutes the second paint brush container with the second color. Also, the removable paint brush container 26 facilitates cleaning the paint brush container 26 and without having to clean the entire flat member 14.

Additionally, the removable paint brush container 26 facilitates having paint brush containers of different sizes, which may accommodate different sized paint brushes.

The present invention as described herein provides time and money savings in terms of cutting fatigue and increasing the efficiency of a painter when painting. Further, in practice a painter will always know where his paint brush is, and have easy access to the paint brush, be he on a ladder, or painting from the floor, and painting the trim between the wall and the ceiling. The paint brush carrier 10 relieves a painter from having to walk across a room to pick up the paint brush from a bucket or can of paint, while he may be rolling paint on to a roller brush. These advantages can increase the overall efficiency and reduce the fatigue of a painter.

An additional advantage reducing fatigue and increasing efficiency to the painter, is not requiring the painter to climb down a ladder or scaffolding and chase a falling brush. Furthermore, a paint brush stays cleaner and in better shape since the paint brush container 26 would not necessarily have paint poured therein. Thus the paint brush 8 would not be immersed in paint and hence less time would be required to clean the paint brush 8. Paint would not be near the handle end of the paint brush 8, cutting cleaning time and prolonging the life of the paint brush 8. If the paint brush 8 were instead left on the bucket and slipped into the bucket the paint brush 8 would be more difficult to clean.

An additional advantage of the present invention is safety. The paint brush carrier 10 gives the painter a free hand that usually would not be free while holding onto the paint brush 8, while the painter is climbing a ladder, scaffolding, or other device, or leaning to maintain balance. Additionally, a painter is less likely to drop the paint brush 8 from a ladder while using paint brush carrier 10.

In a preferred embodiment of the present invention, the paint brush carrier 10 would be fabricated from a plastic. The plastic would be of a material which would be resistant to solvents or paint, but yet flexible. The flexibility would allow a painter to readily clean the paint brush container 26 by flexing and bending the paint brush container 26, thereby having dried paint break and fall from the container.

It will be apparent to those skilled in the art that various modifications can be made to the paint brush carrier of the instant invention without departing from the scope or spirit of the invention, and it is intended that the present invention cover modifications and variations of the paint brush carrier provided they come within the scope of the appended claims and their equivalents.

I claim:

1. A paint brush carrier for holding a paint brush, wherein said paint brush includes a handle and a brush, comprising:

a pocket clip for clipping to a pocket of a pair of pants;

a flat member having a rectangular shape with a first surface and a second surface and with a first end and a second end, said flat member, at the first surface and near the first end of said flat member, pivotally connected to said pocket clip;

a handle clip connected to said flat member, at the second surface and near the first end of said flat member, for clipping the handle of said paint brush;

at least a first attachment slot connected to said flat member, at the second surface and near the second end of said flat member, said first attachment slot projecting out from said second surface of said flat member;

a paint brush container for holding the brush end of said paint brush; and an attachment hook connected to said paint brush container wherein said attachment hook inserts into said attachment slot on said flat member, for holding said paint brush container to said flat member.

2. The paint brush carrier as set forth in claim 1, further comprising:

a second attachment slot connected to said flat member, at the second surface near the second end of said flat member, said second attachment slot projecting out from the second surface of said flat member, wherein said attachment hook inserts into said second attachment slot, and said second attachment slot increases stability of said attachment hook for holding said paint brush container to said flat member.

3. The paint brush carrier as set forth in claim 2 wherein:

said flat member includes attachment means located near the second end of said flat member; and said paint brush container includes hook means connected to said container for hooking said container to said attachment means of said flat member.

4. A paint brush carrier for holding a paint brush, wherein said paint brush includes a handle and a brush, comprising:

a clip;

a member with a first surface and a second surface, said member connected to said clip;

a handle clip connected to the second surface of said member for clipping the handle of said paint brush to said member;

at least a first attachment slot connected to said member, said first attachment slot projecting out from said second surface of said member;

a paint brush container for holding the brush end of said paint brush; and an attachment hook connected to said paint brush container wherein said attachment hook inserts into said attachment slot on said member, for holding said paint brush container to said member.

5. The paint brush carrier as set forth in claim 4 wherein said paint brush container has a shape approximating the shape of said paint brush.

6. The paint brush carrier as set forth in claim 1 wherein said paint brush container has a shape approximating the shape of said paint brush.

* * * * *